US007241951B2

(12) United States Patent
Donazzi et al.

(10) Patent No.: US 7,241,951 B2
(45) Date of Patent: Jul. 10, 2007

(54) METHOD FOR SHIELDING THE MAGNETIC FIELD GENERATED BY AN ELECTRICAL POWER TRANSMISSION LINE, AND MAGNETICALLY SHIELDED ELECTRICAL POWER TRANSMISSION LINE

(75) Inventors: Fabrizio Donazzi, Milan (IT); Paolo Maioli, Crema (IT); Yuri A. Dubitsky, Milan (IT); Vladimir I. Petinov, Moscow (RU); Robert S. Kasimov, Moscow (RU)

(73) Assignee: Pirelli & C. S.p.A., Milan (IT)

( * ) Notice: Subject to any disclaimer, the term of this patent is extended or adjusted under 35 U.S.C. 154(b) by 0 days.

(21) Appl. No.: 10/482,124

(22) PCT Filed: Jun. 19, 2002

(86) PCT No.: PCT/EP02/06779

§ 371 (c)(1),
(2), (4) Date: Dec. 7, 2005

(87) PCT Pub. No.: WO03/003382

PCT Pub. Date: Jan. 9, 2003

(65) Prior Publication Data

US 2006/0151195 A1 Jul. 13, 2006

Related U.S. Application Data

(60) Provisional application No. 60/303,138, filed on Jul. 6, 2001.

(30) Foreign Application Priority Data

Jun. 29, 2001 (EP) ..... 01115881

(51) Int. Cl.
*H01B 7/34* (2006.01)

(52) U.S. Cl. ..... 174/36

(58) Field of Classification Search ..... 174/36, 174/110 R, 113 R, 113 C, 110 A–110 FC, 174/120 R, 102 R, 108
See application file for complete search history.

(56) References Cited

U.S. PATENT DOCUMENTS 2,787,651 A * 4/1957 Lapsley ..... 174/32

(Continued)

FOREIGN PATENT DOCUMENTS

CN 2390264 Y 6/2000

(Continued)

OTHER PUBLICATIONS

P. Argaut et al., "Shielding Technique to Reduce Magnetic Fields From Buried Cables", A10.5, JICABLE, (8 pages) 1999.

(Continued)

*Primary Examiner*—William H. Mayo, III
(74) *Attorney, Agent, or Firm*—Finnegan, Henderson, Farabow, Garrett & Dunner, L.L.P.

(57) ABSTRACT

A method for shielding the magnetic field generated by an electrical power transmission line having at least one electrical cable. A magnetic shield is provided in a position radially external to at least one electrical cable. The magnetic shield has at least one pair of shielding layers made from different ferromagnetic materials, radially superimposed and having their maximum relative magnetic permeability increasing in a radial direction from the inside toward the outside of the magnetic shield. An electrical power transmission line provided with multiple-layer magnetic shield and a multiple-layer magnetic shield.

36 Claims, 8 Drawing Sheets

U.S. PATENT DOCUMENTS

| | | | | |
|---|---|---|---|---|
| 3,160,702 | A * | 12/1964 | Lapsley | 174/32 |
| 3,594,492 | A * | 7/1971 | Bahder et al. | 174/36 |
| 4,499,438 | A * | 2/1985 | Cornelius et al. | 333/1 |
| 4,639,544 | A * | 1/1987 | Dableh et al. | 174/32 |
| 5,313,017 | A * | 5/1994 | Aldissi | 174/36 |
| 5,389,736 | A * | 2/1995 | Ziemek et al. | 174/36 |
| 6,225,556 | B1 * | 5/2001 | Saito | 174/36 |
| 6,287,657 | B1 * | 9/2001 | Gebizlioglu | 428/36.91 |
| 6,806,418 | B2 * | 10/2004 | Donazzi et al. | 174/36 |
| 6,870,109 | B1 * | 3/2005 | Villarreal | 174/102 R |
| 2004/0055772 | A1 * | 3/2004 | Tsutsui et al. | 174/36 |

FOREIGN PATENT DOCUMENTS

| | | |
|---|---|---|
| EP | 0 606 884 | 7/1994 |
| GB | 885165 | 12/1961 |
| JP | 10117083 | 5/1998 |

OTHER PUBLICATIONS

P. Chaudhari et al., "Metallic Glasses", Scientific American, No. 42, pp. 98-100, 102, 104-106, 108-110, 112, 114, 117, Jun. 1980.

* cited by examiner

METHOD FOR SHIELDING THE MAGNETIC FIELD GENERATED BY AN ELECTRICAL POWER TRANSMISSION LINE, AND MAGNETICALLY SHIELDED ELECTRICAL POWER TRANSMISSION LINE

CROSS REFERENCE TO RELATED APPLICATIONS

This application is a national phase application based on PCT/EP02/06779, filed Jun. 19, 2002, the content of which is incorporated herein by reference, and claims the priority of European Patent Application No. 01115881.3, filed Jun. 29, 2001, and claims the benefit of U.S. Provisional Application No. 60/303,138, filed Jul. 6, 2001.

BACKGROUND OF THE INVENTION

Field of the Invention

The present invention relates to a method for shielding the magnetic field generated by an electrical power transmission line.

The present invention also relates to a magnetically shielded electrical power transmission line, and to a multiple-layer magnetic shield designed to provide magnetic shielding of said transmission line.

SUMMARY OF THE INVENTION

Description of the Related Art

In general, a high-power electrical power transmission line is designed to withstand voltages of the order of hundreds of kV (typically 400 kV) and currents of the order of hundreds of Ampére (typically 300–2000 A). Therefore the electrical power transmitted in these lines can reach values of the order of thousands of MVA, typically 1000 MVA.

In general, the electrical current transmitted by said lines is of the low frequency alternating type. For the purposes of the present description, the term "low frequency" denotes frequencies of less than 400 Hz, typically 50 or 60 Hz.

In particular, the present invention relates to a cable for transmitting or distributing electrical power at high voltage, with alternating current at low frequency.

For the purposes of the present description, the term "low voltage" denotes a voltage of less than approximately 1 kV, the term "medium voltage" denotes a voltage in the range from approximately 1 kV to approximately 30 kV, and the term "high voltage" denotes a voltage of more than approximately 30 kV.

Said transmission lines are conventionally used for transmitting electrical power from electrical power stations to centers of population, over distances of the order of tens of km (normally 10–100 km).

In general, said lines are buried and, preferably, located within conduits positioned at a depth of approximately 1–1.5 m below the ground level.

In a conventionally used configuration, said transmission lines are of the three-phase type, comprising three separate cables, preferably combined with each other to form a trefoil structure.

In the space immediately surrounding the cables, the magnetic field H, generated by the current flowing in said cables, can reach particularly high values, for example of the order of $10^3$ A/m.

Therefore, this means that the magnetic induction B at the ground level due to the magnetic field H can reach particularly high values, for example of the order of 20–60 μT, said values also depending on the location with respect to each other of the individual cables forming the aforesaid transmission line.

Although at present there are no scientifically verified data that demonstrate any harmful effects on the human body caused by a continual exposure to magnetic fields of said entity, generated by low-frequency sources (for example of the order of 50 Hz, in other words at industrial frequency), recently the international scientific community has been paying particular attention to this problem which forms part of the more complex phenomenon generally known as "electrosmog".

This term signifies the pollution caused by electrical, magnetic and electromagnetic fields which are commonly produced by electrical equipment and electrical installations in general.

In this scenario, the Applicant has aimed to keep the magnetic induction, generated by an electrical power transmission line, at or below a threshold value.

Therefore, in order to safeguard the health of the population and protect the environment, the Applicant considered that a threshold value of not more than 0.5 μT, and preferably not more than 0.2 μT, was sufficiently conservative.

Some technical solutions designed to shield the magnetic field generated by an electrical power transmission line are known in the art.

The article by P. Argaut, J. Y. Daurelle, F. Protat, K. Savina and C. A. Wallaert, "Shielding technique to reduce magnetic fields from buried cables", A 10.5, JICABLE 1999, for example, describes some solutions for shielding the magnetic fields generated by a buried line consisting of three separate cables.

In particular, it describes the results of some simulations conducted by using both shields of open section (for example a sheet of ferromagnetic material located above the cables), and shields of closed section (for example a conduit of rectangular section made from ferromagnetic material, containing the three cables inside it).

Moreover, said article also analyses the dependence of the shielding efficiency on a plurality of factors, such as the relative magnetic permeability of the shielding material used, the thickness of said material, and the position of the magnetic shield with respect to the cables.

According to the aforesaid article, the optimal material for shielding said line is one having a relative magnetic permeability in the range from 700 to 1,000 and a thickness in the range from 3 mm to 5 mm.

Additionally, in the case in which a shield of the closed section type is used, said article discloses that the optimal relative position of the cables and the shield is that according to which the cables are located approximately ⅓ of the way from the top of the shield.

Finally, it is pointed out that shielding factors of the magnetic field, generated by said line, of approximately 5–7 can be obtained with open section shields, while shielding factors of approximately 15–20 can be obtained with closed section shields.

Furthermore, shielding factors of approximately 30–50 can be obtained in the case in which the closed section shield is positioned very near to the cables, for example in the case in which a sheet of ferromagnetic material is wound directly around the three cables.

Patent application (Kokai) JP 10-117083 describes a further solution for shielding the magnetic field generated by an electrical power transmission cable.

In detail, the proposed solution consists in making a pipe from a ferromagnetic material within which the cables of the transmission line can be positioned. Preferably, said pipe is produced by spirally winding a strip of magnetic material on a tubular support, such as a tube of resin or metallic material, within which said cables are positioned.

This spiral winding can be carried out in a single step, to form a single shielding layer, or it is possible to provide a plurality of steps to form a plurality of superimposed layers of the same shielding material.

In the described example, the strip is made from grain-oriented steel and has a greater magnetic permeability in a direction parallel to the winding direction than in the direction perpendicular to said winding direction.

The term "grain-oriented" denotes a material in which the crystal domains (grains) essentially have a preferred direction of alignment.

This alignment can be evaluated by known methods, for example by optical microscope examination or by X-ray diffractometry, and can be produced by special rolling and annealing processes, as described, for example, in document EP-606,884.

Document U.S. Pat. No. 5,389,736 relates to a cable, particularly a control cable or a cable for transmitting power at high frequency (of the order of several MHz), specifically for naval use, provided with a shield for the electromagnetic shielding of the conductors of the cable.

According to said document, this shield is such that it provides, in addition to the desired shielding effect, a good temperature-resistance, even in case of fire, and a good flexibility of the cable with a limited thickness of the shield.

This shield comprises an inner layer, consisting of one or more copper bands forming an electromagnetic shield having an attenuation factor in the range from 80 to 115 dB, and an outer layer, formed by a steel band, capable of ensuring good resistance to high temperatures, as well as corrosion-resistance and protection from the external environment.

However, the Applicant has observed that some prior art solutions, such as those described in the article by Argaut et al., are not capable of satisfactorily shielding the magnetic field generated by an electrical transmission line.

Furthermore, the Applicant has observed that other prior art solutions, such as that described in patent application JP 10-117083 cited above, are based on the use of a magnetic shield made from a single shielding material.

This type of shielding, although providing a good shielding effect, does not represent an optimal solution, since it is necessary to satisfy two conflicting requirements, namely to limit the thickness of the shield, in order to reduce its weight and cost, while providing efficient shielding of the magnetic field produced by the transmission line.

However, in the case of a shield made from a single material, the shielding efficiency depends both on the thickness used (since the shielding effect increases with an increase in the thickness of the shield) and on the type of material chosen, whose relative magnetic permeability, corresponding to the value of the magnetic field H generated by the line, has to fall outside the saturation zone so that said material can operate efficiently.

For the above reasons, a magnetic shield made from a single material is a compromise solution, and is therefore not an optimal solution in terms of cost and/or shielding efficiency and/or thickness of the shield used.

The Applicant has considered the problem of providing an efficient shielding of the magnetic field generated by an electrical power transmission line.

In particular, the Applicant has perceived that it is necessary to shield the magnetic field generated by a high-power transmission line, located in a trench dug in the ground, in such a way that a value of magnetic induction not exceeding 0.5 μT, and preferably not exceeding 0.2 μT, is obtained at a given distance from the centre of said line (preferably approximately 1–1.5 m).

The Applicant has found that this technical result can be achieved by preparing a magnetic shield of the multiple-layer type, which encloses within it the electrical power transmission line which is to be shielded.

In particular, the Applicant has found that it is possible to obtain a desired value of shielding (for example equal to or less than 0.5 μT) by using a multiple-layer shield having a reduced thickness (and therefore reduced weight and cost) and high shielding efficiency (exploiting to the full the shielding properties of each material used), which can suppress the magnetic field in a progressive way as it passes from one layer to the next of the multiple-layer magnetic shield according to the invention.

In greater detail, the Applicant has found that said shielding results can be achieved by providing a multiple-layer magnetic shield, each layer being produced from a ferromagnetic material different from that of the adjacent layer.

In other words, the Applicant has found that the modularity in a radial direction of said magnetic shield enables the magnetic field generated by the transmission line to be remarkably reduced progressively, and that each layer can thus be made from a ferromagnetic material chosen in such a way as to have a suitable relative magnetic permeability.

Therefore, in so doing, each individual layer is such that the magnetic field is remarkably reduced to a desired extent, and operates in optimal conditions, fully exploiting the shielding properties of the material used to form the individual layer.

Therefore, in a first aspect the present invention relates to a method for shielding the magnetic field generated by an electrical power transmission line comprising at least one electrical cable, said method comprising the provision of a magnetic shield in a position radially external to said at least one electrical cable, characterized in that the maximum relative magnetic permeability of said magnetic shield increases in a radial direction from the inside towards the outside of said magnetic shield.

In greater detail, said magnetic shield comprises:

- a first radially inner layer, comprising at least one first ferromagnetic material, and
- at least one second layer, radially external to the first layer, comprising at least one second ferromagnetic material, in which the maximum relative magnetic permeability of said at least one first ferromagnetic material is lower than the maximum relative magnetic permeability of said at least one second ferromagnetic material.

Moreover, the Applicant has found that, in order to improve the shielding of the magnetic field produced by a transmission line, it is particularly convenient to provide an additional shielding element which can shield the transmission line from the earth's magnetic field.

This is because the materials of the shielding layers of said shield which, as stated above, are placed in a position radially external to the transmission line, are polarized by the earth's magnetic field. This means, therefore, that the ferromagnetic material of the outermost layer of the multiple-layer shield according to the invention has to allow for not only the magnetic field produced by the cable, but also for the earth's magnetic field. In other words, the ferromagnetic material of said outermost layer has to be chosen in such a way that it has a maximum relative magnetic permeability at the value of H which is the sum of the aforesaid two magnetic fields.

According to the embodiment mentioned above, said additional shielding element is designed in such a way that the materials of the shielding layers of said shield, particularly the ferromagnetic material of the outermost layer, are not disturbed by the presence of the earth's magnetic field and can operate at the best of their shielding capacities, focusing their action exclusively on the magnetic field generated by the transmission line.

Therefore, according to a preferred embodiment of the present invention, said shielding method is characterized in that said shielding of the earth's magnetic field is carried out by providing at least one shielding element made from ferromagnetic material in a position radially external to said magnetic shield.

In a preferred embodiment of the present invention, said shielding method comprises the provision of a conduit within which the transmission line is placed, said conduit being positioned in a cable-laying trench excavated in the ground.

In a preferred embodiment, said conduit is used solely to contain within it said transmission line provided with the multiple-layer magnetic shield according to the invention.

In a further embodiment, said conduit is used as the support for the multiple-layer magnetic shield according to the invention.

In a further embodiment, said conduit is used as the support for one or more layers of the magnetic shield according to the invention, while the remaining layers forming said shield are wound directly onto the cables forming the transmission line.

Advantageously, said conduit is made from a material of the polymer type, such as polyethylene (PE) or polyvinylchloride (PVC), or from resin-glass fibre laminate.

In a preferred embodiment, the method according to the invention comprises the placing of the cable or the cables of said line within the aforesaid conduit, in such a way that the centre of gravity of a cross section of said line is close to the geometrical centre of a corresponding section of the conduit.

Advantageously, the method according to the invention comprises the winding of at least one elongate element, for example a cord, around the cable or cables of said line.

In a second aspect, the present invention relates to an electrical power transmission line, comprising:

at least one electrical cable, and a magnetic shield placed in a position radially external to said at least one electrical cable, characterized in that the maximum relative magnetic permeability of said magnetic shield increases in a radial direction from the inside towards the outside of said magnetic shield.

In greater detail, said magnetic shield comprises:

a first radially inner layer comprising at least a first ferromagnetic material, and at least one second layer radially external to the first, comprising at least a second ferromagnetic material, in which the maximum relative magnetic permeability of said at least a first ferromagnetic material is lower than the maximum relative magnetic permeability of said at least a second ferromagnetic material.

In a first embodiment, the transmission line according to the invention comprises a magnetic shield provided with a first radially inner shielding layer and with at least a second shielding layer radially external to the first.

Said first layer and at least a second layer made from different ferromagnetic materials, chosen in such a way that the maximum relative magnetic permeability of said materials increases in a radial direction, namely from said first layer towards said at least a second layer.

The Applicant has made a multiple-layer magnetic shield which, since it is provided with a plurality of layers, each of which can provide for the maximum achievable shielding effect, can keep the magnetic induction due to the magnetic field generated by the transmission line at or below a desired threshold value.

In particular, the multiple-layer shield according to the invention enables the magnetic induction to be kept at or below the aforesaid value at a distance of approximately one meter from the outermost surface of said shield, in any radial direction with respect to the transmission line.

Advantageously, said first layer and said at least a second layer, placed in a position radially superimposed on the electrical cables of said line, are in contact with each other.

According to a further embodiment of the present invention, the multiple-layer magnetic shield is placed in a position radially external to the cables of said transmission line, and the radially inner layer of said shield is in contact with said cables.

According to a further embodiment, the transmission line comprises a conduit within which are located the electrical cables forming said line, said conduit being placed on the bottom of a cable-laying trench excavated in the ground.

Preferably, said conduit is made from a material of the polymer type, such as PE or PVC, or from resin-glass fibre laminate.

According to a further embodiment, the multiple-layer magnetic shield described above is placed in a position radially external to said conduit and in contact with the radially outer surface of the latter.

According to a preferred embodiment, an additional shielding element is placed in a position radially external to said multiple-layer magnetic shield for shielding the earth's magnetic field.

As mentioned above, since the earth's magnetic field has an effect on the magnetic properties of the materials forming each layer of the magnetic shield, the Applicant has perceived the necessity of preparing a shielding element suitably dedicated to the shielding of the earth's magnetic field in such a way that the layers of said multiple-layer magnetic shield can operate at the best of their shielding potential, without reduction of their shielding effect due to the influence of the earth's magnetic field.

According to said further embodiment of the invention, the ferromagnetic material from which said shielding element is made is such that its magnetization curve (H, μ) reaches a peak at the value of the earth's magnetic field. The earth's magnetic field is essentially a static field with a value of approximately 40 A/m.

In a preferred embodiment, said shielding element is in a position radially external to said at least a second layer and in contact with the latter.

In a further embodiment, said shielding element is in a position radially external to the aforesaid conduit and is in contact with the latter, while said first layer and said at least a second layer are radially superimposed on the electrical cables forming said line.

In a further embodiment, the transmission line according to the invention comprises an elongate element wound spirally around the electrical cables of said transmission line.

Preferably, said elongate element is a cord of dielectric material, advantageously selected from the group comprising polyamide fibres, aramidic fibres, and polyester fibres.

In a third aspect, the present invention relates to a multiple-layer magnetic shield, comprising:

a first radially inner layer comprising at least a first ferromagnetic material, and at least a second layer radially external to said first layer, comprising at least a second ferromagnetic material, in which the maximum relative magnetic permeability of said at least a first ferromagnetic material is lower than the maximum relative magnetic permeability of said at least a second ferromagnetic material.

Preferably, each layer of said magnetic shield is produced by a taping operation, if necessary by providing a plurality of windings to form each layer.

In a particular embodiment, the tapes forming the layers of said shield are helicoidally wound according to a predetermined pitch with partial overlapping of the axially adjacent winding coils.

According to a further embodiment, each layer of said magnetic shield is made in a tubular shape, for example by extrusion, or by rolling to form a sheet of predetermined dimensions which is subsequently bent and welded along its longitudinally opposing edges.

Preferably, each layer of said multiple-layer magnetic shield is made from a ferromagnetic material such as: silicon steel, metallic glass alloys, or polymer materials filled with a ferromagnetic material, for example ferromagnetic nanoparticles, powdered ferrite or iron filings.

BRIEF DESCRIPTION OF THE DRAWINGS

Further characteristics and advantages will be more clearly understood from the detailed description of some examples of the present invention.

This description, given below, refers to the attached drawings which are supplied solely by way of example and without restrictive intent, and in which.

DETAILED DESCRIPTION OF THE INVENTION

For the purposes of the present description, the term "magnetization curve" denotes a curve describing the variation of the relative magnetic permeability $\mu_r$ of a material with respect to an applied magnetic field H, as determined according to IEC standard 404, "Magnetic materials".

In particular, according to this standard, the magnetic permeability is measured by immersing a ring of material in a magnetic field directed circumferentially with respect to the ring.

Figure 2:
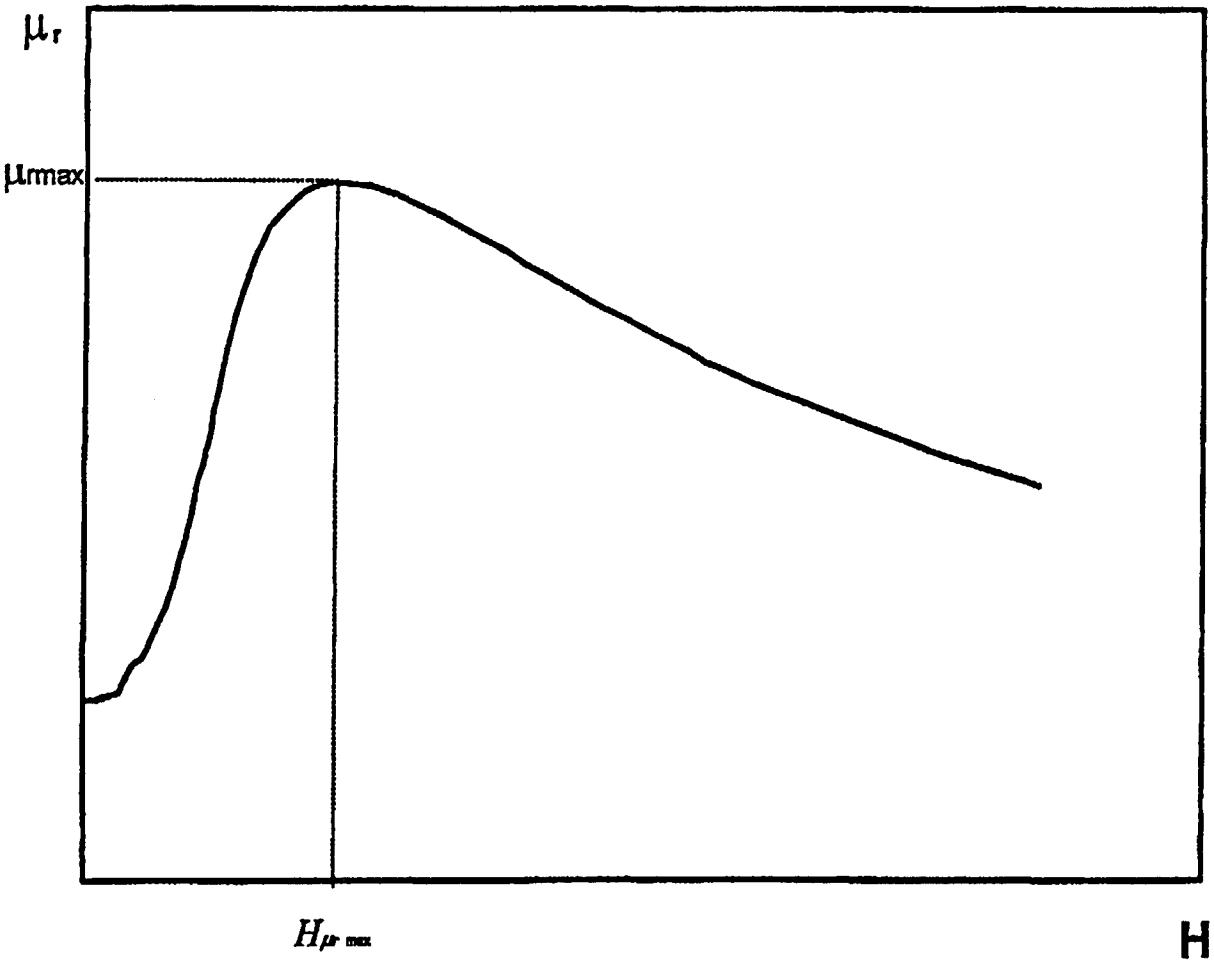
FIG. 2 shows schematically a typical magnetization curve (H, $\mu_r$) of a ferromagnetic material, where the coordinates ($H_{\mu max}$, $\mu_{max}$) of the peak of the curve are indicated.

An example of the magnetization curve of a ferromagnetic material is shown schematically in FIG. 2. The symbols $\mu_{rmax}$ and $H_{\mu rmax}$ indicate the coordinates of the peak of said curve.

The Applicant has perceived that the shielding capacity of the multiple-layer magnetic shield according to the present invention depends on the value assumed by the magnetic field within the shielding material of each layer of said shield.

In particular, the Applicant has perceived that the magnetic field generated by the cables forming an electrical power transmission line can be efficiently reduced, to reach values of magnetic induction of 0.2 μT or even lower, by preparing a multiple-layer magnetic shield in which each layer is made from a ferromagnetic material whose magnetization curve is such that the peak of said curve (in other words, the maximum relative magnetic permeability $\mu_{rmax}$) is centred on a value of the magnetic field (namely $H_{\mu rmax}$) approximately equal to the value that the magnetic field has within the ferromagnetic material of each layer.

In fact, the relative magnetic permeability of the shielding material has a very high value in the peak region of said magnetization curve, and therefore the fact that said material can be made to operate within said region ensures that there is maximum shielding for each layer of the multiple-layer magnetic shield according to the invention. In other words, if the magnetic field has a value close to $H_{\mu rmax}$ within the material of each layer, the material itself has a high magnetic permeability, and therefore a high shielding capacity, in other words a high ability to "trap" the magnetic field within it.

Figure 1:
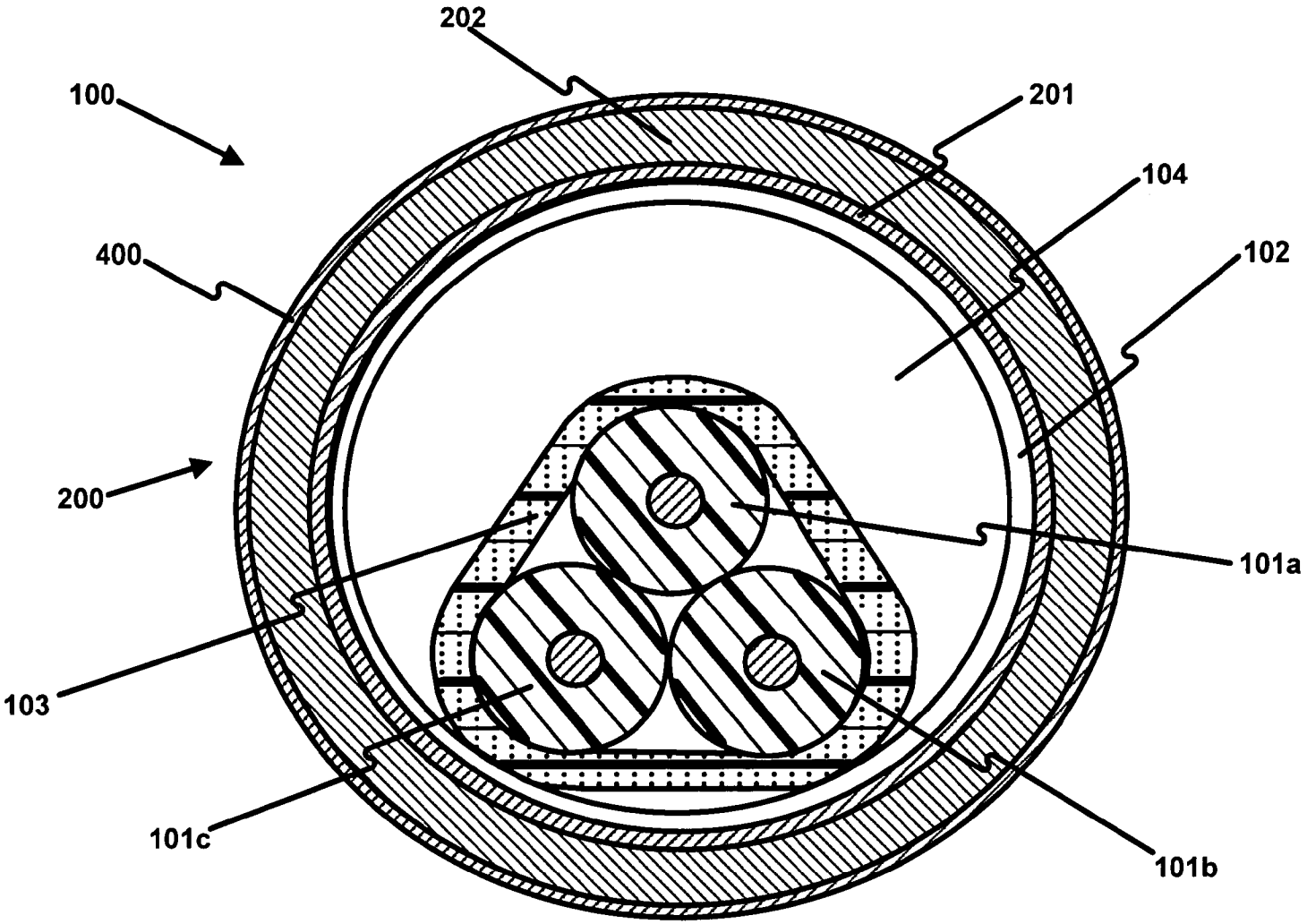
FIG. 1 shows a schematic cross section of a transmission line according to one embodiment of the present invention.

FIG. 1 shows a schematic cross section of a high-power electrical transmission line 100 according to an embodiment of the invention.

Said line 100 comprises three cables 101*a*, 101*b* and 101*c*, each carrying an alternating current at low frequency, typically 50 or 60 Hz.

Said cables 101*a*, 101*b* and 101*c* are arranged in a trefoil configuration, in other words in such a way that, in a cross-sectional view such as that of FIG. 1, the geometrical centres of said cables are approximately located on the vertices of a triangle.

Advantageously, said cables are in contact with each other.

Typically, each of the cables 101*a*, 101*b* and 101*c* comprises: a conductor; an inner semiconductive coating; an insulating coating, made for example from cross-linked polyethylene (XLPE); an outer semiconductive coating; a metallic shield; a metallic armour; and a polymeric sheath for protection from the external environment.

If necessary, a metallic sheath can also be placed in a position radially external to said polymeric sheath, as a moisture-proof barrier.

The total external diameter of each cable is typically in the range from 80 to 160 mm.

The transmission line 100 shown in FIG. 1 also comprises a conduit 102 within which the cables 101*a*, 101*b* and 101*c* are arranged according to the aforesaid trefoil configuration.

Preferably, said conduit 102 has a closed cross section, of essentially circular shape, and has a thickness generally in the range from 1 mm to 10 mm, and preferably from 3 mm to 5 mm.

Preferably, said conduit 102 is made from PE, PVC or resin-glass fibre laminate.

In general, the internal diameter of the conduit 102 is chosen within a range from 2.3 to 2.8 times the diameter of the cable carrying a single phase, in such a way as to make the operation of laying the cables within the conduit sufficiently easy.

Preferably, the cables 101*a*, 101*b* and 101*c* are located in a position raised above the bottom of the conduit 102, in such a way as to reduce the distance between the centre of gravity of a cross section of the cable trefoil and the geometrical centre of a corresponding cross section of the conduit 102. This has a positive effect on the magnetic induction at a given distance from the line (for example, 1–1.5 m), said magnetic induction being advantageously decreased.

In order to provide this type of arrangement of the trefoil within the conduit 102, the cables 101*a*, 101*b* and 101*c* are supported by a suitable supporting element 103.

In a preferred embodiment which is illustrated in FIG. 1, said supporting-element 103 is represented by an elongate element wound spirally around said trefoil of cables. Preferably, this elongate element is a cord.

The use of this supporting element, and the consequent displacement of the centre of gravity of the cables towards the geometric centre of the conduit, causes the flux lines of the magnetic induction to be remarkably gathered within the conduit itself and to have a more symmetrical arrangement.

Additionally, the supporting element 103 makes it possible to reduce the losses due to parasitic currents, which are located in the regions of the conduit 102 near the contact points of the cables 101*a*, 101*b* and 101*c*, thanks to the displacement of the two cables 101*b* and 101*c* away from the bottom of the conduit: in the upper region of the conduit 102 there is a slight increase in losses, due to the corresponding approach of the cable 101*a*. The overall effect is a reduction in losses.

Advantageously, the use of an element wound around the cables 101*a*, 101*b* and 101*c* allows the cables to be kept in close contact with each other at all times, even when they might tend to separate as a result of thermomechanical or electromechanical forces.

By keeping the cables in contact with each other, the distance between the centres of the cables, in other words between the centres of the currents flowing in the cables, can be reduced to a minimum along the conduit 102, with a consequent lowering of the magnetic induction to be shielded.

The diameter of the supporting element 103 can be chosen in such a way as to bring the centre of gravity of the cables closer to the geometrical centre of the conduit 102 (seen in section), to a distance preferably less than (D-d)/6, where D is the internal diameter of the conduit 102 and d is the external diameter of one of the cables 101*a*, 101*b* and 101*c*.

In this way it is possible to obtain a good compromise between the reduction of magnetic induction and the limitation imposed by the overall dimensions of the whole comprising the supporting element and the cables within the conduit 102.

In an alternative embodiment, the cables 101*a*, 101*b* and 101*c* are supported in direct contact with the bottom of the conduit 102 and no supporting element 103 is provided.

In the space 104 within the conduit 102 which is not occupied by the trefoil of cables 101*a*, 101*b* and 101*c* and by the support 103, air is generally present. However, in some cases it may be advantageous to introduce a fluid, for example an inert gas, into said space 104.

In one particular embodiment, a slight excess of pressure is used within the conduit 102 in order to prevent the ingress of moisture from outside the conduit. For example, dry nitrogen can be introduced into the inner space 104 and the conduit is then subjected to a slight internal excess of pressure of approximately 0.5 bar. Thus the moisture-proofing metallic sheath, which is usually placed in a position radially external to each cable, becomes unnecessary.

The transmission line 100, according to the embodiment shown in FIG. 1, also comprises a multiple-layer magnetic shield 200 placed in a position radially external to the conduit 102 and in contact with the latter.

According to said embodiment, the magnetic shield 200 is formed by two shielding layers 201, 202, made from ferromagnetic material which is different in each layer.

In detail, a first radially inner shielding layer 201 is placed in direct contact with the outer surface of the conduit 102 and has the function of partially reducing the magnetic field generated by the line 100, so that a second shielding layer 202, radially external to the first layer 201, can be selected and designed in such a way as to efficiently shield the magnetic field which is generated by the line and is not shielded by said first layer 201. In particular, since the magnetic field generated by said line has been partially shielded by said first layer, the ferromagnetic material of said second layer can be selected in such a way as to have a relative magnetic permeability greater than that of the material of said first layer, and therefore to be capable of effectively shielding the magnetic field which is not shielded by said first layer.

According to the embodiment shown in FIG. 1, a shielding element 400 is placed in a position radially external to said magnetic shield 200 and it can carry out the function of shielding the line 100 from the earth's magnetic field.

Said transmission line 100 is typically buried in a cable-laying trench, generally at a depth not less than 0.5 m, and preferably in the range from 1 to 1.5 m, this value relating to the point at which the line rests on the bottom of the trench.

According to a further embodiment of the present invention (not shown), the multiple-layer magnetic shield 200 is placed in a position radially external to the trefoil of cables 101*a*, 101*b* and 101*c*, and in contact with said trefoil.

In this case, since the conduit 102 is in direct contact with the ground inside the cable-laying trench, it is also necessary to cover the outer wall of said conduit with corrosion-proofing materials, for example polyethylene or bitumen.

According to a further embodiment (not shown), the multiple-layer magnetic shield 200 according to the present invention is such that the layers forming said shield are not all sequentially positioned in contact with each other.

According to a further embodiment (not shown), the first shielding layer 201 and the second shielding layer 202 are radially superimposed on the trefoil configuration of said cables 101*a*, 101*b* and 101*c*, and the shielding element 400 is in a position radially external to the conduit 201 and in contact with the latter.

When the multiple-layer magnetic shield according to the invention or the shielding element are placed in a position radially external to the conduit 102, it is preferable they are covered with a sheath for protection from the external environment, for example a PE sheath (not shown in the figure).

For laying a transmission line according to the present invention, for example one of the type shown in FIG. 1, in general the cable-laying trench is prepared and then the conduit 102 is positioned inside it, the latter being normally made in a plurality of separate lengths and fitted with the multiple-layer magnetic shield 200.

The individual lengths are then joined together by welding or by another method, and the trench is filled in to enable the area affected by the laying to be rapidly restored.

The cables of the line are then inserted into one end of the conduit and pulled from the other end.

In the preferred embodiment shown in FIG. 1, in a step preceding their insertion into the conduit 102, the cables 101*a*, 101*b* and 101*c* are joined together in the trefoil configuration.

The next step is to wind the elongate element 103 around said configuration, thus preventing the movement of one cable with respect to another, and the structure thus obtained is then inserted into the conduit 102.

During the laying of the cables, the cord 103 is subject to considerable traction because of the weight of the cables 101*a*, 101*b* and 101*c* and the friction with the bottom of the conduit 102: for this reason, the material from which the elongate element 103 is made has to be able to withstand both the traction and the abrasion caused by the friction with the bottom wall of the conduit.

Preferably, said elongate element is a dielectric material. Even more preferably, said material is selected from the group comprising polyamide fibres (for example nylon), polyester fibres, and aramidic fibres (for example Kevlar®).

In order to further describe the invention, some examples of embodiments which are illustrative of the invention, but are not limiting in respect of it, are provided hereinbelow.

EXAMPLE 1

A three-phase line for transmitting electrical power at 400 kV and 1500 A, of the type shown in FIG. 1, and buried in a trench at a depth of 1.5 m, was considered.

Said line comprised three cables arranged in a trefoil configuration, each cable having a conventional structure respectively comprising, in a radial direction from the inside to the outside of the cable: a conductor of the Milliken type made from enamelled copper, with a section of 1600 $mm^2$; an inner semiconductive coating; an insulating coating of cross-linked polyethylene (XLPE); an outer semiconductive coating; a metallic shield; a metallic armour and an outer polymeric sheath. The external diameter of the cable was 122 mm.

Said transmission line also comprised an elongate element made from nylon, with a diameter of 36 mm, wound around the aforesaid trefoil configuration in a radially external position according to a spiral having a pitch of 1 m.

Said line was also provided with a conduit suitable for containing inside it the aforesaid trefoil configuration. Said conduit was made from resin-glass fibre laminate, produced by impregnating a matrix of glass wool with hardening resin, and had an internal diameter of 263 mm and a thickness of 0.7 mm, making the external diameter of the conduit of 264.4 mm.

The multiple-layer magnetic shield according to the invention was placed in a position radially external to said conduit, and comprised a first radially inner layer in direct contact with the outer surface of the conduit and a second layer, radially external to the first layer and in contact with the latter.

In detail, the ferromagnetic material used to make said first radially inner layer was grain-oriented silicon steel (referred to below as a-FeSi-1) with the formula $Fe_{96.8}Si_{3.2}$, cold-rolled and subjected to an annealing treatment.

The chemical and physical characteristics of said silicon steel a-FeSi-1 were as follows:

density $\delta$=7650 kg/$m^3$;

electrical resistivity $\rho_{el}=5\times10^{-7}$ Ω*m;

magnetic induction at saturation $B_s$=1.98 T;

coercive field $H_c$=52 A/m.

Figure 3:
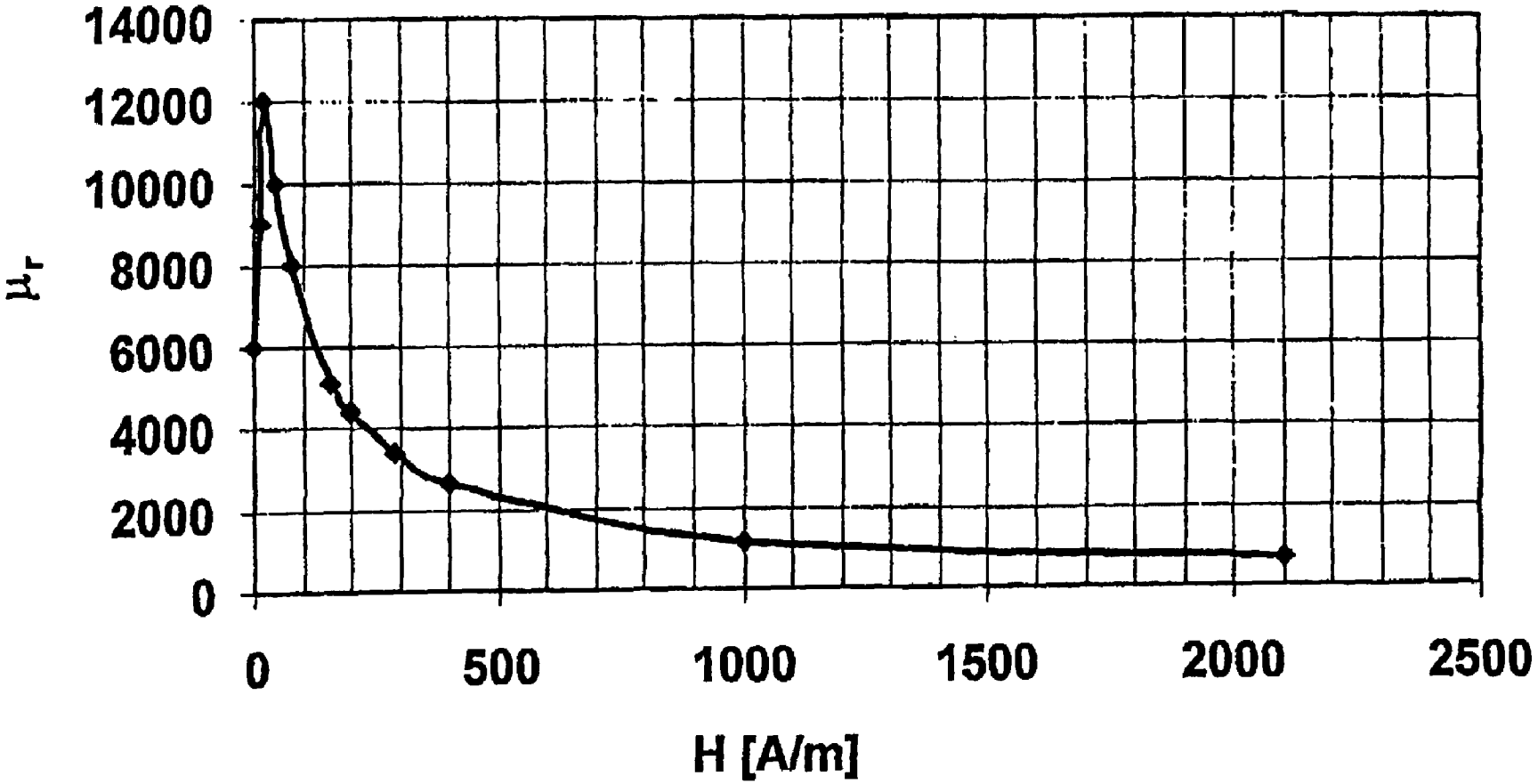
FIGS. 3 and 4 show the magnetization curves of two different ferromagnetic materials used for making shielding layers.

FIG. 3 shows the magnetization curve (H, $\mu_r$) of said steel. For the values of H and $\mu_r$ of said material, said values being obtainable from the magnetization curve of FIG. 1, Table I shows the values of magnetic induction B determined by means of the following equation:

$$B=\mu_r\times\mu_0\times H \quad (1)$$

where $\mu_0$ is the vacuum magnetic permeability equal to $1.257\times10^{-6}$ (H/m)

TABLE I

| H (A/m) | $\mu_r$ | B (T) |
|---|---|---|
| 0 | 6000 | 0 |
| 10 | 9000 | 0.08 |
| 20 | 12000 | 0.30 |
| 40 | 10000 | 0.50 |
| 80 | 8000 | 0.80 |
| 159 | 5100 | 1.02 |
| 200 | 4400 | 1.10 |
| 290 | 3380 | 1.21 |
| 400 | 2620 | 1.31 |
| 1000 | 1160 | 1.47 |
| 2100 | 690 | 1.87 |

The Applicant has found that an increase in the grain size of the steel was accompanied by a corresponding improvement in the shielding capacity of the layer. According to international standards, the grain size of a steel can be determined by means of a non-dimentional index G (according to ASTM standard E-112), which can be obtain by counting the number of grains present in a predetermined area. Therefore, the index G decreases as the grain size increases.

Said first radially inner layer of the multiple-layer magnetic shield according to the invention was produced by carrying out 7 successive windings of a tape having a width of 20 mm and a thickness of 80 μm. Said tape was advantageously provided on its outer surface with a silicon oxide film, acting as an electrical insulator, having a thickness of 1.5 μm and making the total thickness of the tape of 81.5 μm. Therefore, said first layer had a total thickness of approximately 0.6 mm and an external diameter of approximately 265.6 mm.

The total thickness of said first layer, and consequently the number of windings required to achieve said total thickness, was calculated as follows.

The magnetic field H can be calculated by the following Biots-Savart equation which is valid for the calculation of the magnetic field at a certain distance from a straight filament current of infinite length:

$$H = \frac{I}{2\pi d} \quad (2)$$

where, in the present case,

H is the magnetic field present at a distance d from the source giving rise to the aforesaid field, for example a cable 101*a*, 101*b* and 101*c*; and I is the current flowing in said cable.

With reference to the line configuration 100 shown in FIG. 1, but disregarding the presence of the conduit 102 and the elongate element 103 and the simultaneous presence of three separate cables 101*a*, 101*b* and 101*c*, the value of H on the outer surface of one of said cables was 3,913 A/m, said value being determined by substituting in equation (2) the value of 1,500 A for the flowing current I and the value of 61 mm for the cable radius d.

Since said value of the magnetic field H was calculated at the most critical point, in other words at the point of contact with the cable, it was assumed to have a value of H equal to half of the calculated value, in other words equal to 1,956 A/m, in such a way that a substantially average value present in the layer was considered.

Additionally, in the absence of a magnetic shield, since the transmission line 100 generated a magnetic induction B of 34 μT at the ground (value calculated by means of the Biots-Savart equation in the vector form), while, as mentioned above, one of the Applicant's aims was to obtain a value of magnetic induction equal to, or even lower than, 0.2 μT, in order to achieve said aim it was necessary to provide said line with a magnetic shield capable of reducing the magnetic field H by a factor of 170 times with respect to the initial value of said field in the absence of a magnetic shield. Therefore, the value 170 represented the total shielding factor $S_{tot}$ of the magnetic shield as a whole.

It was decided that a shielding effect of 5% should be attributed to the first radially inner shielding layer; in other words, it was decided that said first layer should be able of suppressing 5% of the magnetic field generated by the line. Therefore a shielding factor $S_1$ of 8.5 (said value being 5% of $S_{tot}$) was attributed to said first layer, said shielding factor being generally defined as:

$$S = \frac{H_{inc}}{H_{tr}} \quad (3)$$

where, in the aforesaid specific case relating to said first radially inner layer:

$H_{inc}$ is the incident magnetic field, in other words the magnetic field which is generated by the line and reaches said first shielding layer;

$H_{tr}$ is the transmitted magnetic field, in other words the magnetic field leaving said first layer; in other words, $H_{tr}$ represents the fraction of the magnetic field produced by the line which is not shielded by said first layer.

If $H_{inc}$ is given a value of 1,956 A/m and $S_1$ is given a value of 8.5 in the aforesaid equation (3), we find that $H_{tr}$ is equal to 230 A/m.

On the other hand, the shielding factor S can also be calculated according to the following equation (valid for cylindrical shields whose thickness is small with respect to the diameter):

$$S = 0.66\mu_r \frac{\delta}{R} \quad (4)$$

where:

$\mu_r$ is the relative magnetic permeability of the material used;

δ is the thickness of the layer in question;

R is the average radius of the layer in question.

Since the ferromagnetic material was known, namely a-FeSi-1, then, in accordance with the magnetization curve of FIG. 3 and Table I for said material, a value of 2,500 was chosen for the average relative magnetic permeability $\mu_r$, corresponding to the range of the magnetic field from $H_{inc}$=1,956 A/m to $H_{tr}$=230 A/m.

Therefore, by applying equation (4) to said first shielding layer, it was possible to select a thickness δ, and therefore a radius R, in such a way that the desired shielding factor $S_1$, namely 8.5, was obtained.

It was then calculated that, when the thickness δ of the first shielding layer was 0.6 mm (corresponding, as mentioned above, to an external diameter of approximately 265.6 mm and a sequence of 7 successive windings of the aforesaid tape), the shielding factor $S_1$ had a value of 7.6, said value being sufficiently close to the desired value of 8.5.

According to the invention, the multiple-layer magnetic shield also had a second layer, radially external to the first layer.

In detail, the ferromagnetic material used for said second layer was silicon steel (referred to below as a-FeSi-2) similar to that of the first layer, but subjected to a further annealing treatment.

Figure 4:
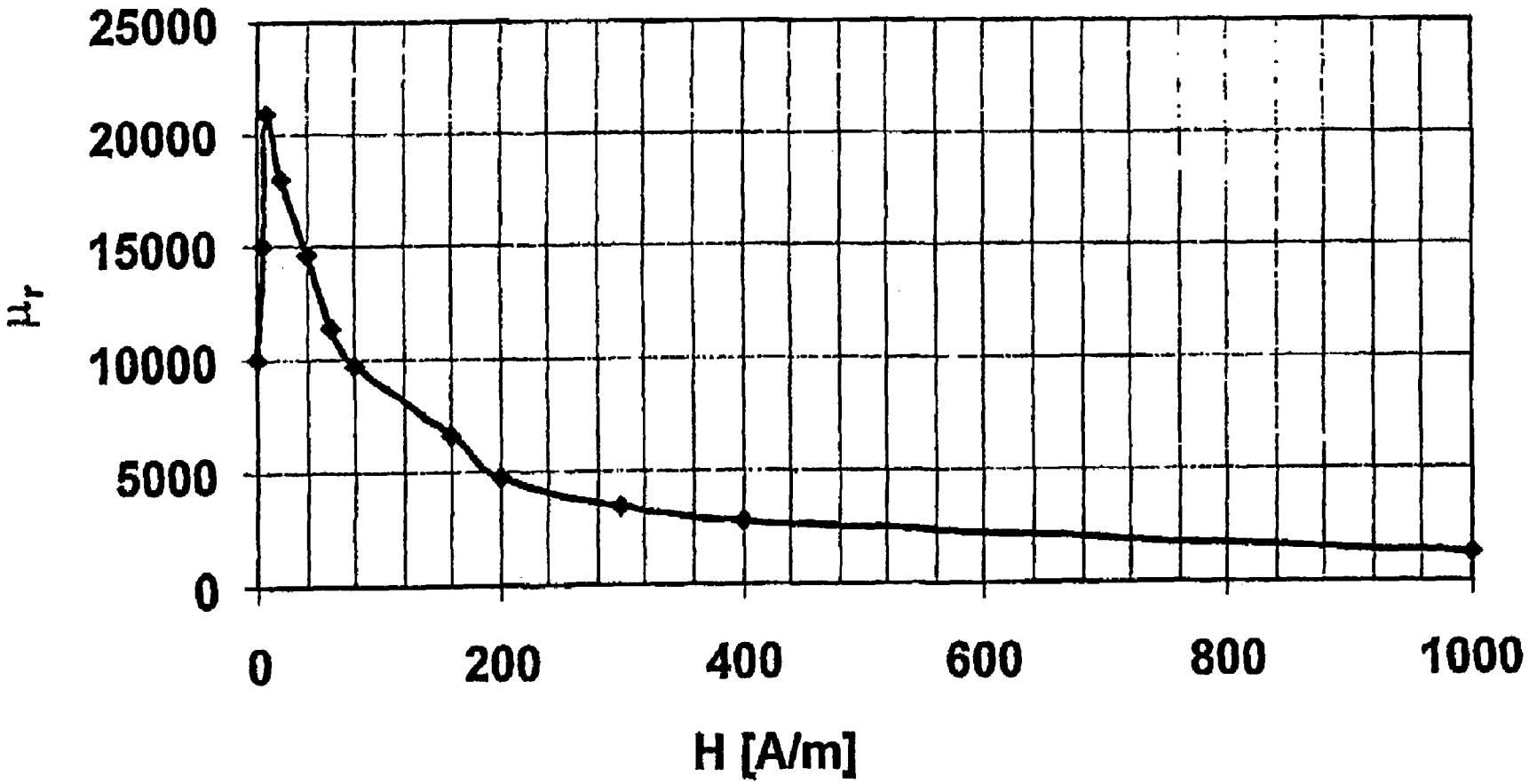

FIG. 4 shows the magnetization curve (H, $\mu_r$) of said steel. Table II shows the values of magnetic induction B obtained by using equation (1), for values of H and $\mu_r$ relating to the aforesaid material which can be determined from the magnetization curve of FIG. 4.

TABLE II

| H (A/m) | $\mu_r$ | B (T) |
|---|---|---|
| 0 | 10,000 | 0 |
| 4 | 15,000 | 0.08 |
| 8 | 21,000 | 0.210 |
| 20 | 18,000 | 0.450 |
| 40 | 14,600 | 0.730 |
| 60 | 11,300 | 0.851 |
| 80 | 9,700 | 0.970 |
| 160 | 6,600 | 1.12 |
| 200 | 4,720 | 1.18 |
| 300 | 3,360 | 1.26 |
| 400 | 2,640 | 1.32 |
| 1,000 | 1,150 | 1.44 |

Said second layer, radially external to the first layer, of the multiple-layer magnetic shield according to the invention was produced by carrying out 40 successive windings of a tape having a width of 20 mm and a thickness of 80 μm. In a similar way to that described for the tape forming the first radially inner layer, also the tape forming said second layer was provided on its outer surface with a film of silicon oxide, acting as an electrical insulator, with a thickness of 1.5 μm, making the total thickness of the tape 81.5 μm. Therefore, said second layer had a total thickness of approximately 3.2 mm and an external diameter of approximately 272 mm.

By a similar method to that followed for the first radially inner layer, the value of the total thickness of said first layer, and consequently the number of windings required to obtain said total thickness, was calculated by means of equations (3) and (4), making the value of the shielding factor $S_2$ equal to 160 (in other words approximately 95% of the magnetic field generated by the transmission line). In particular, when $S_2$ was made equal to 160 and $H_{inc}$ equal to 230 A/m, the transmitted magnetic field (in other words, the magnetic field leaving the second shielding layer) $H_{tr}$ was found to be approximately 2 A/m, and, on the basis of this range of values from $H_{inc}$ to $H_{tr}$, and by using the magnetization curve of FIG. 4 and the data of Table II relating to said ferromagnetic material a-Fe—Si-2, an average value of relative magnetic permeability $\mu_r$ of approximately 12,000 was calculated and used for insertion into the equation (4).

Therefore, by means of said equation (4) it was possible to select a thickness δ, and therefore a radius R of said second shielding layer, in such a way as to obtain the desired shielding factor $S_2$, in other words a shielding factor equal to 160.

It was then calculated that, when the thickness δ of the second shielding layer was 3.2 mm (corresponding, as mentioned above, to an external diameter of approximately 272 mm and to a sequence of 40 successive windings of the aforesaid tape), the shielding factor $S_2$ was equal to 186, said value being sufficiently close to the desired value of 160.

According to the invention, an additional shielding element was placed in a position radially external to the second layer of said magnetic shield, said shielding element having the function of shielding said second layer from the inflow of the earth's magnetic field.

Due to the properties of symmetry of the magnetic field equations, the shielding factor S can generally be calculated by using the equation (3) in the case the source of the magnetic field is inside or outside the shielding layer. Therefore, in the case of said shielding element, the equation (3) becomes:

$$S_3 = \frac{H_{inc}}{H_{tr}} = \frac{H_{earth}}{H_{tr}} \tag{3'}$$

where $H_{earth}$ represents the value of the earth's magnetic field, in other words the magnetic field incident on said shielding element.

The earth's magnetic field $H_{earth}$ has a value, at medium latitudes, which is essentially constant and equal to 40 A/m.

Additionally, in this situation the transmitted magnetic field $H_{tr}$ is to be understood as being the residual earth's magnetic field which is not shielded by said shielding element, and which is therefore incident on said second shielding layer. Since, as shown in Table II, the maximum relative magnetic permeability of the ferromagnetic material of said second layer is found in the presence of a magnetic field in the range from 8 A/m to 20 A/m, and it is Applicant's desire that said second layer operates in conditions of maximum permeability, the choice was made to introduce a transmitted magnetic field value $H_{tr}$ of 8 A/m into equation (3'). Therefore, on the basis of the aforesaid values, it was obtained from equation (3') that the shielding factor $S_3$ was equal to 5.

It was decided that said shielding element should be made from the same ferromagnetic material as said second shielding layer, two successive windings being carried out to give a total thickness of said shielding element equal to approximately 0.1 mm and an external diameter-equal to approximately 272.2 mm.

By a similar method to that followed for the first radially inner layer and for the second layer, radially external to the first layer, the value of the total thickness of said shielding element, and consequently of the total number of windings necessary to provide said total thickness, was calculated by means of equations (3') and (4). In particular, on the basis of the range of values from $H_{earth}$ equal to 40 A/m to $H_{tr}$ equal to 8 A/m, and by using the magnetization curve of FIG. 4 and the data from Table II relating to said ferromagnetic material a-FeSi-2, an average value of relative magnetic permeability $\mu_r$ of approximately 10,000 was calculated, for insertion into equation (4).

Therefore, by using said equation (4) it was possible to select a thickness δ, and consequently a radius R, of said shielding element, in such a way as to obtain the desired shielding factor $S_3$, namely 5.

It was therefore calculated that, when the thickness δ of the second shielding layer was equal to 0.1 mm (corresponding, as mentioned above, to an external diameter of approximately 272.2 mm and a sequence of 2 successive windings of the aforesaid tape), the shielding factor $S_3$ had a value sufficiently close to the desired value of 5.

Therefore, the total thickness of the assembly formed by the multiple-layer magnetic shield and the shielding element was approximately 4 mm, and the total shielding factor $S_{tot}$ was 198.6.

The shielding factor $S_{tot}$ of the high-voltage electrical power transmission and distribution line, within which an electrical current of 1,500 A flows, is equal to 194, this value being obtained by using the equation (4) into which are inserted the aforesaid total thickness, the average radius of said assembly and a value of relative magnetic permeability which is the average of those of the layers forming said multiple-layer shield and of the additional shielding element.

Consequently, the aforesaid shielding factor $S_{tot}$ of 198.6 is essentially equal to the shielding factor $S_{tot}$ ($=S_1+S_2+S_3$) of 194, which demonstrates the shielding efficiency of the solution according to the invention.

The transmission line 100 provided with the multiple-layer magnetic shield 200 and the shielding element 400 according to the invention was subjected to a measurement of the magnetic induction field B.

Figure 5:
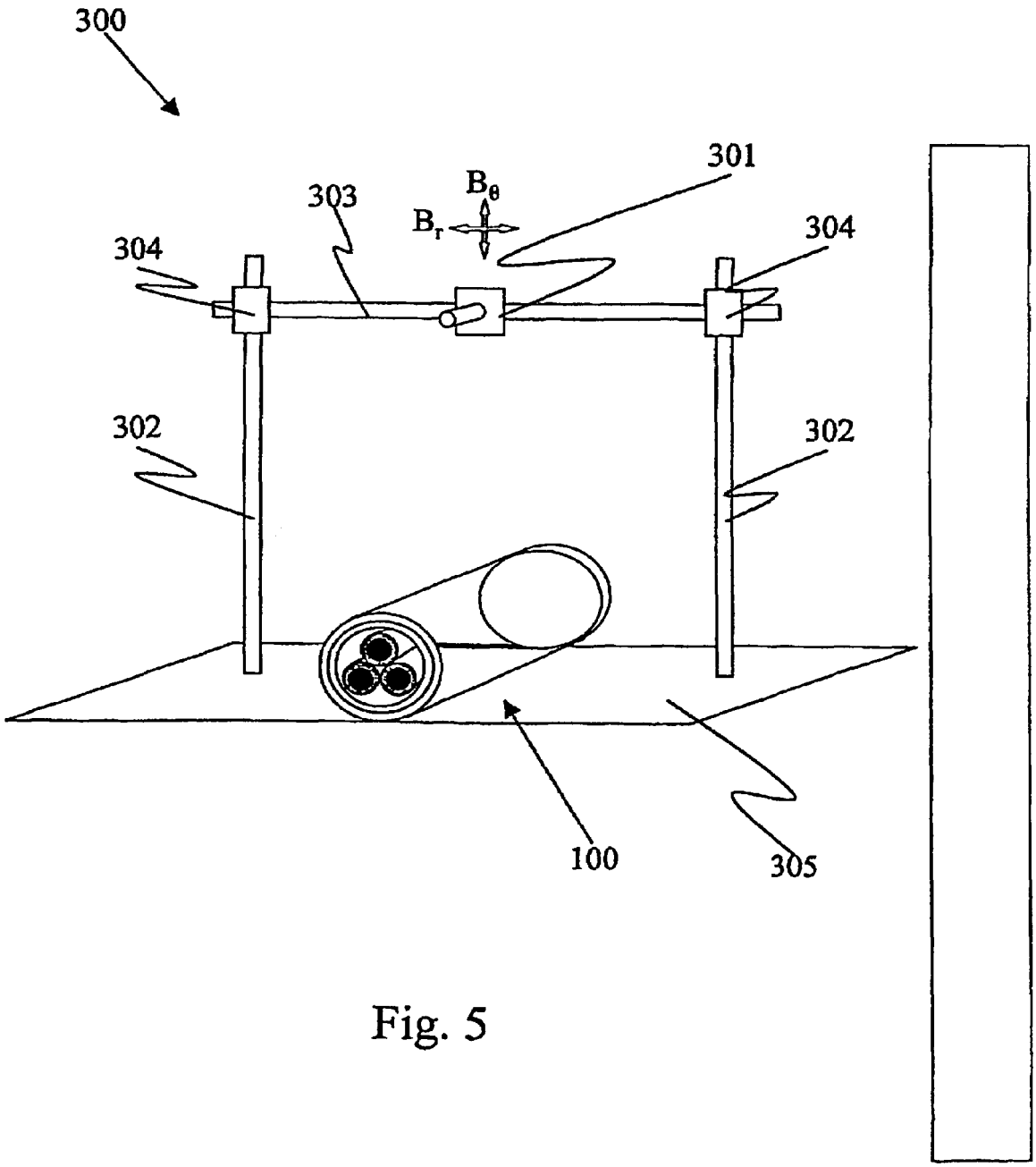
FIG. 5 shows a schematic perspective view of a device for measuring the magnetic induction B as a function of the distance from a transmission line.

For this measurement, a measuring device 300, shown schematically in FIG. 5, was prepared, said device comprising a measuring sensor 301 which can be moved horizontally and vertically in such a way that it could be positioned at a predetermined distance from said transmission line 100.

In detail, the measuring device 300 comprises a pair of uprights 302 which can support a post 303 on which said measuring sensor 301 is removably positioned. The post 303 is fixed to said uprights 302 by a pair of blocks 304 which allow the measuring sensor 301 to be positioned as desired with respect to the transmission line 100, the latter being illustrated in FIG. 5 as arranged on a support surface 305.

The operation of said blocks 304 is such that they provide both a horizontal movement of the uprights 302, enabling them to be moved towards and/or away from the transmission line 100, and a vertical movement of the post 303, enabling it to be moved towards and/or away from said transmission line 100. These movements thus permit the desired positioning of the measuring sensor 301 with respect to the line 100 for detecting the magnetic induction B at a given distance from said line.

The measuring device 300 is made entirely from non-ferromagnetic material, generally Plexiglas, to avoid affecting the measurements.

The measurement method is particularly simple, in that it consists in positioning the sensor at a predetermined distance and in measuring the radial magnetic induction $B_r$ and the circumferential magnetic induction $B_\theta$.

In the example in question, the following values were measured:

$B_r$=0.11 μT $B_\theta$=0.15 μT.

Therefore, since the modulus of the magnetic induction is:

$$|B|=\sqrt{B_r^2+B_\theta^2} \quad (5)$$

by substituting the aforesaid measured values in (5), it was obtained that |B|=0.18 μT.

Furthermore, the assembly formed of the multiple-layer magnetic shield and the additional shielding element according to the invention was subjected to a finite elements simulation to evaluate the reliability of the data measured experimentally with the aforesaid measuring device 300.

Figure 6:
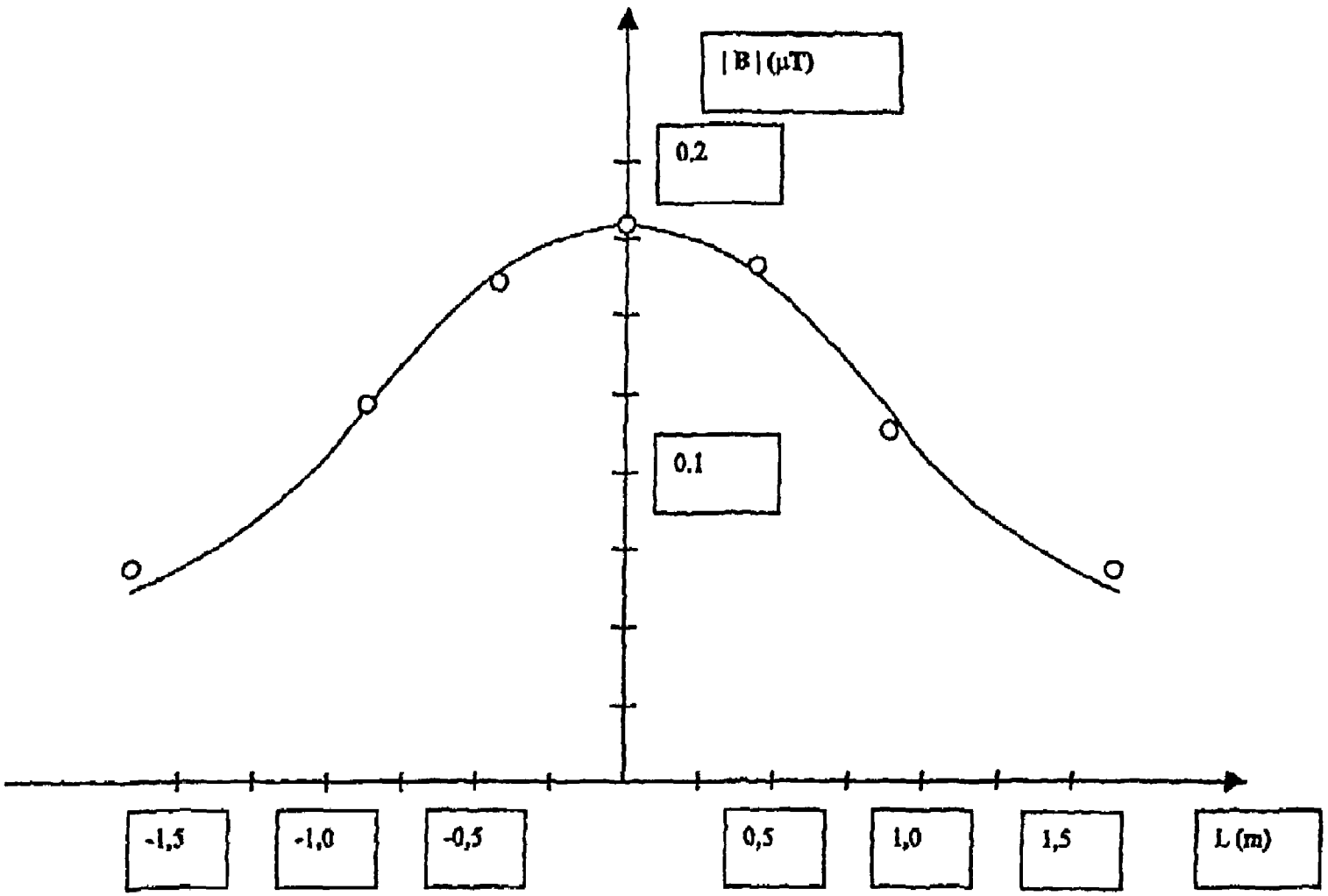
FIG. 6 shows a comparison of the variation of the modulus of magnetic induction as a function of the distance from the transmission line, carried out by a finite elements calculation and by an experimental method.

FIG. 6 shows the modulus of the magnetic induction |B| as a function of the distance L from the axis of the transmission line. In particular, the curve shown in the solid line was obtained by a finite elements calculation, while the points calculated experimentally by means of the aforesaid measuring device are indicated by dots.

An analysis of said figure revealed a high degree of correspondence between the experimental points and the curve calculated theoretically on the computer, which demonstrated the validity of said measuring device.

EXAMPLE 2

A three-phase line similar to that of Example 1 was considered, provided with a multiple-layer magnetic shield comprising a radially inner layer similar to that of Example 1.

According to the invention, said multiple-layer magnetic shield also had a second layer, radially external to the first layer, made from silicon steel of the a-FeSi-2 type described above.

Said second layer was produced by carrying out 12 successive windings of a tape having dimensions equal to those of Example 1, achieving a total measured thickness of approximately 1.07 mm in said second layer.

The multiple-layer magnetic shield according to the invention also had a third layer, radially external to the second layer, made from a particular type of metallic glass (referred to below as "MetGlass A"), said material having the property of possessing a relative magnetic permeability greater than that of the silicon steel.

In general, metallic glasses are materials which have a composition of the metallic type, but have a non-crystalline (or amorphous) microscopic structure typical of glass. Essentially, they may be described as metallic alloys of the glass type which can be obtained, for example, by an abrupt cooling of said alloys. The rapidity of said cooling is essential to ensure that the material does not have sufficient time to form centres of nucleation, and therefore does not have sufficient time to crystallize (see, for example, the article by Praveen Chaudhari, Bill C. Giessen and David Turnbull, in Scientific American, No. 42, June 1980).

The MetGlass A used for said third layer had the formula $Co_{68}Fe_4MoNiSi_{16}Bi_{10}$, whose chemical and physical characteristics are as follows:

magnetic induction at saturation $B_s$=0.476 T coercive field $H_c$=3.2 A/m

Figure 7:
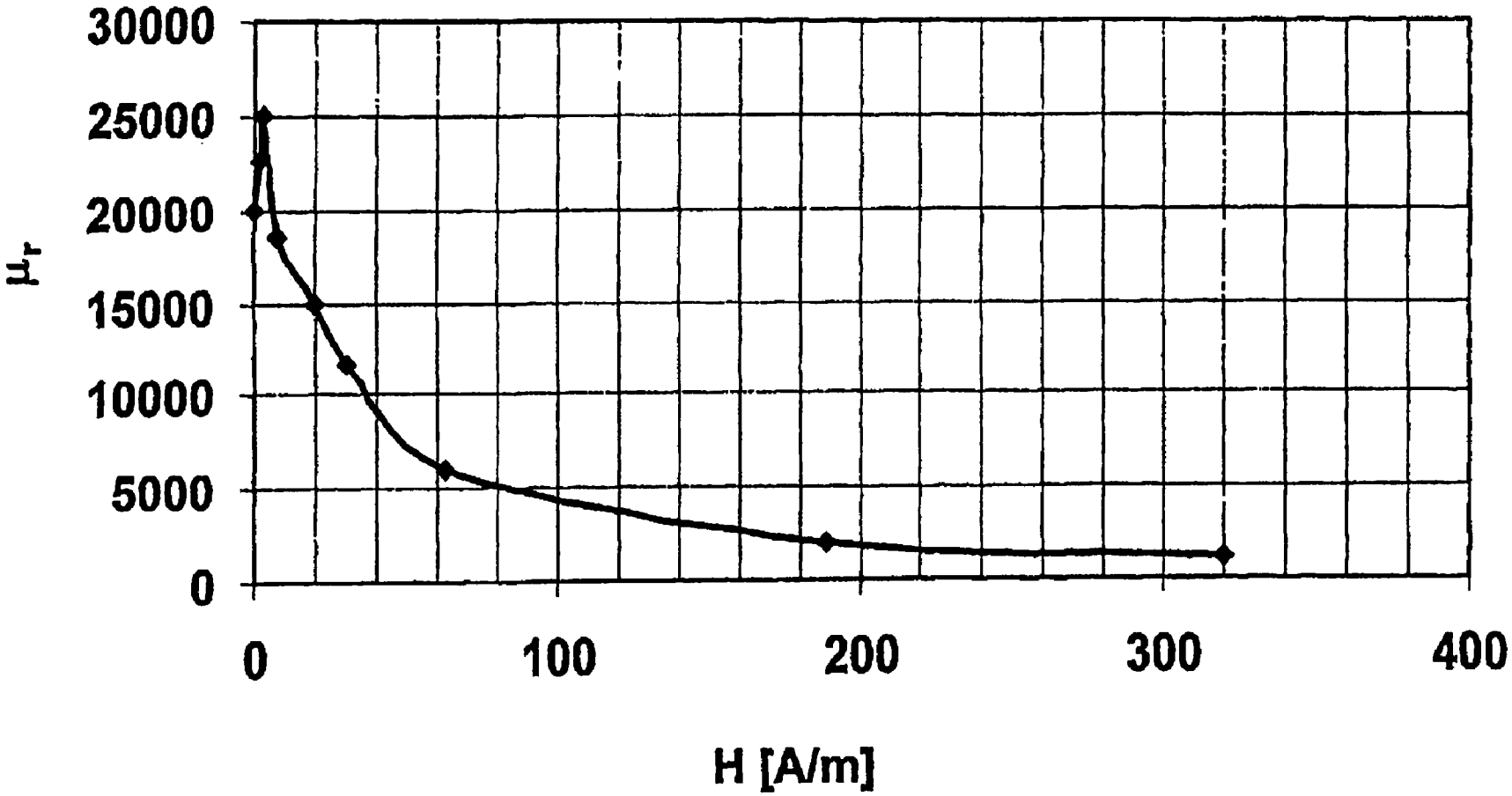
FIGS. 7 and 8 show the magnetization curves of further ferromagnetic materials used to make shielding layers.

FIG. 7 shows the magnetization curve (H, $\mu_r$) of said material. In Table III, the values of magnetic induction B are shown for the values of H and $\mu_r$ relating to the aforesaid material, these values being determined from the magnetization curve of FIG. 7.

TABLE III

| H (A/m) | $\mu_r$ | B (T) |
|---|---|---|
| 0 | 20,000 | 0 |
| 1.5 | 22,500 | 0.042 |
| 3 | 25,000 | 0.094 |
| 8 | 18,500 | 0.185 |
| 20 | 15,000 | 0.375 |
| 31 | 11,700 | 0.457 |
| 63 | 6,010 | 0.475 |
| 189 | 2,000 | 0.475 |
| 320 | 1,174 | 0.475 |

Said third layer was obtained by carrying out 10 successive windings of a tape having a width of 14.8 mm and a thickness of 35.5 μm, making the total thickness of said layer approximately 0.4 mm.

Said thickness was calculated in a similar way to that described in Example 1.

The multiple-layer magnetic shield according to the invention also had a fourth layer, radially external to said third layer and made from a further different type of metallic glass (referred to below as "MetGlass B"), having the same chemical formula as MetGlass A but subjected to an annealing heat treatment designed to increase the relative magnetic permeability $\mu_r$ and reduce $H_{\mu r max}$.

Figure 8:
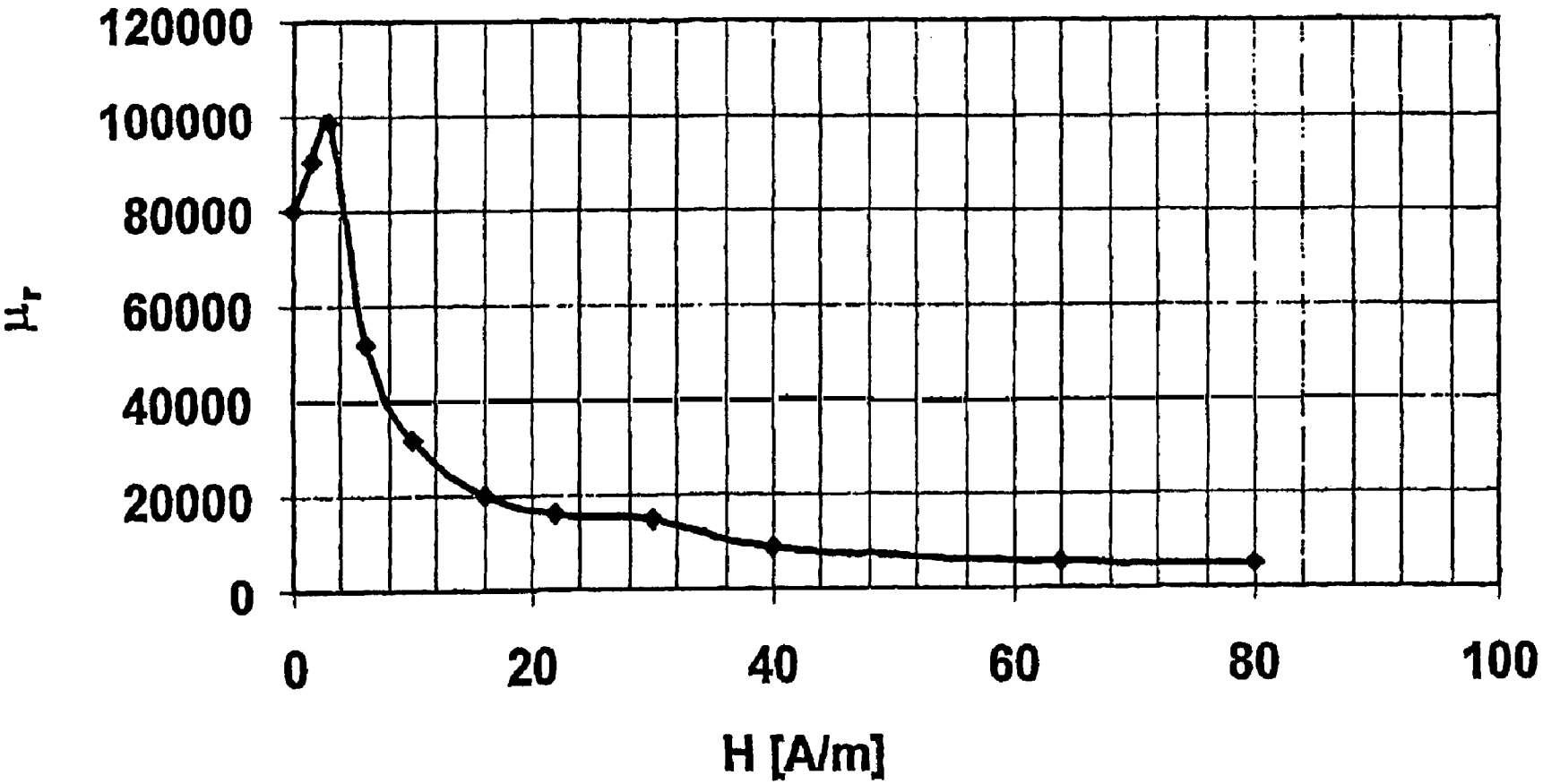

FIG. 8 shows the magnetization curve (H, $\mu_r$) for said material. In Table IV, the values of magnetic induction B are shown for the values of H and $\mu_r$ relating to the aforesaid material, said values being determined from the magnetization curve of FIG. 8.

TABLE IV

| H (A/m) | $\mu_r$ | B (T) |
|---|---|---|
| 0 | 80,000 | 0 |
| 1.5 | 90,000 | 0.170 |
| 3 | 98,400 | 0.380 |
| 6 | 52,130 | 0.391 |
| 10 | 31,680 | 0.396 |
| 16 | 20,000 | 0.401 |
| 22 | 15,900 | 0.415 |
| 30 | 14,900 | 0.431 |
| 40 | 9,020 | 0.451 |
| 64 | 6,135 | 0.488 |
| 80 | 4,900 | 0.488 |

Said fourth layer was obtained by carrying out 20 successive windings of a tape having a width of 14.8 mm and a thickness of 16 μm, making the total thickness of said layer approximately 0.38 mm.

Said thickness was calculated in a similar way to that described in Example.

In a similar way to that illustrated in Example 1, an additional shielding element was placed in a position radially external to the fourth layer of the multiple-layer magnetic shield, in order to shield said fourth layer from the effects of the earth's magnetic field.

To prevent the material forming said fourth layer from being polarized in the presence of the earth's magnetic field, and therefore to prevent it from operating in the saturation region, the shielding effect provided by said shielding element had to be such that the magnetic field reaching said fourth layer were less than 1 A/m.

Therefore, by substituting 40 A/m for $H_{inc}$ and 1 A/m for $H_{tr}$ into equation (3'), it was obtained that the shielding factor S of said shielding element was equal to 40.

It was decided to make said shielding element from the same ferromagnetic material as said second shielding layer, by carrying out 7 successive windings to make the total thickness of said shielding element approximately 0.6 mm.

The total thickness of said shielding element, and consequently the number of windings required to achieve said total thickness, was calculated by means of equations (3') and (4). In particular, on the basis of the range of values from $H_{earth}$, equal to 40 A/m, to $H_{tr}$, equal to 1 A/m, and by using the magnetization curve of FIG. 4 and the data of Table II relating to said ferromagnetic material a-FeSi-2, an average value of relative magnetic permeability $\mu_r$ of approximately 8,000 was calculated, and this was inserted into equation (4).

Therefore, by means of said equation (4) it was possible to select a thickness δ, and consequently a radius R of said shielding element, in such a way as to obtain the desired shielding factor S, in other words equal to 40.

It was therefore calculated that, when the thickness δ of said shielding element was equal to 0.6 mm (corresponding to a sequence of 7 successive windings of the aforesaid tape), the shielding factor S had a value sufficiently close to the desired value of 40.

Consequently, the total thickness of the assembly formed of the multiple-layer magnetic shield and of the additional shielding element was approximately 3 mm, making the external diameter approximately 270.4 mm, and the total shielding factor was 40.

The shielding factor $S_{tot}$ of the high-voltage electrical power transmission and distribution line which was provided with the aforesaid multiple-layer magnetic shield and shielding element, and within which an electric current of 1,500 A flowed, was equal to 236, this value being obtained by means of equation (4) into which was inserted the aforesaid total thickness, the average radius of said assembly, and a value of relative magnetic permeability which was an average of those of the layers forming said multiple-layer shield and of the additional shielding element.

By using the measuring device 300 described above, the following values were detected for the example in question:

$$B_r=0.09\ \mu T$$

$$B_\theta=0.123\ \mu T.$$

When said values were substituted in the aforesaid equation (5), the modulus of magnetic induction |B| was found to be equal to 0.15 μT.

Therefore, the multiple-layer magnetic shield according to the present invention enables the magnetic field generated by an electrical power transmission line to be shielded in such a way that the values of magnetic induction in the space surrounding said line can be kept at or below predetermined threshold values.

The use of materials having a relative magnetic permeability which increases from a radially inner shielding layer towards a radially outer shielding layer enhances the shielding properties of the multiple-layer magnetic shield according to the invention.

Therefore, the multiple-layer magnetic shield according to the invention allows to achieve a shielding which is more efficient than that obtained in the prior art, providing an advantageous reduction of the thickness of the shield, and therefore of the weight of the latter, and also of the weight of the cable provided with said shield.

What is claimed is:

1. An electrical power transmission line comprising:

at least one electrical cable; and a magnetic shield having multiple ferromagnetic layers placed in a position radially external to said at least one electrical cable, the maximum relative magnetic permeability of said magnetic shield increasing in a radial direction from the inside toward the outside of said magnetic shield, wherein said magnetic shield comprises:

a first radially inner layer comprising at least a first ferromagnetic material, and at least a second layer radially external to the first layer, said at least a second layer comprising at least a second ferromagnetic material, the maximum relative magnetic permeability of said at least a first ferromagnetic material being lower than the maximum relative magnetic permeability of said at least a second ferromagnetic material.

2. The electrical power transmission line according to claim 1, wherein said first layer and said at least a second layer are radially superimposed and in contact with each other.

3. The electrical power transmission line according to claim 1, wherein said magnetic shield comprises a plurality of radially superimposed shielding layers made from different ferromagnetic materials, the maximum relative magnetic permeability of the ferromagnetic materials of said plurality of shielding layers increasing radially from the inside toward the outside of said shield.

4. The electrical power transmission line according to claim 3, in which said maximum relative magnetic permeability of the ferromagnetic materials of said magnetic shield increases from said radially inner layer toward said at least one radially outer layer.

5. The electrical power transmission line according to claim 1, wherein said magnetic shield is superimposed on said at least one electrical cable and is in contact with said at least one electrical cable.

6. The electrical power transmission line according to claim 1, comprising a conduit within which is placed said at least one electrical cable.

7. The electrical power transmission line according to claim 6, wherein said magnetic shield is in contact with the radially outer surface of said conduit.

8. The electrical power transmission line according to claim 6, further comprising a shielding element comprising at least a ferromagnetic material, said shielding element being placed in a position radially external to said conduit and in contact with the latter.

9. The electrical power transmission line according to claim 8, wherein said first layer and said at least a second layer are radially superimposed on said at least one electrical cable of said line, and said first layer is in contact with said conduit.

10. The electrical power transmission line according to claim 1, further comprising a shielding element comprising at least a ferromagnetic material, said shielding element being placed in a position radially external to said magnetic shield.

11. The electrical power transmission line according to claim 10, wherein said shielding element is superimposed on said at least a second layer and is in contact with the latter.

12. The electrical power transmission line according to claim 10, wherein the magnetization curve of said at least a ferromagnetic material of said shielding element reaches a peak at the value of the earth's magnetic field ($H_{earth}$).

13. The electrical power transmission line according to claim 1, further comprising an elongate element wound spirally around said at least one cable.

14. The electrical power transmission line according to claim 13, wherein said elongate element is a cord of dielectric material.

15. The electrical power transmission line according to claim 14, wherein said dielectric material is selected from the group comprising:

polyamide fibres, aramidic fibres, and polyester fibres.

16. The electrical power transmission line according to claim 1, wherein said magnetic shield further comprises:

at least a third layer radially external to said at least a second layer, said at least a third layer comprising at least a third ferromagnetic material, the maximum relative magnetic permeability of said at least a second ferromagnetic material being lower than the maximum relative magnetic permeability of said at least a third ferromagnetic material.

17. The electrical power transmission line according to claim 16, wherein said magnetic shield further comprises:

at least a fourth layer radially external to said at least a third layer, said at least a fourth layer comprising at least a fourth ferromagnetic material, the maximum relative magnetic permeability of said at least a third ferromagnetic material being lower than the maximum relative magnetic permeability of said at least a fourth ferromagnetic material.

18. A method for shielding the magnetic field generated by an electrical power transmission line comprising at least one electrical cable, said method comprising:

providing a magnetic shield having multiple ferromagnetic layers in a position radially external to said at least one electrical cable, the maximum relative magnetic permeability of said magnetic shield increasing in a radial direction from the inside toward the outside of said magnetic shield, wherein said magnetic shield comprises:

a first radially inner layer comprising at least a first ferromagnetic material; and at least a second layer radially external to the first layer, said at least a second layer comprising at least a second ferromagnetic material, the maximum relative magnetic permeability of said at least a first ferromagnetic material being lower than the maximum relative magnetic permeability of said at least a second ferromagnetic material.

19. The method according to claim 18, further comprising:

providing at least a shielding element in a position radially external to said magnetic shield.

20. The method according to claim 18, further comprising providing a conduit within which said at least one electrical cable is to be placed.

21. The method according to claim 20, further comprising burying said conduit in a trench of predetermined depth.

22. The method according to claim 20, comprising placing said at least one cable in said conduit in such a way that the centre of gravity of a cross section of said at least one cable is close to the geometrical centre of a corresponding section of said conduit.

23. The method according to claim 18, further comprising winding at least an elongate element around said at least one cable.

24. The method according to claim 18, wherein said magnetic shield further comprises:

at least a third layer radially external to said at least a second layer, said at least a third layer comprising at least a third ferromagnetic material, the maximum relative magnetic permeability of said at least a second ferromagnetic material being lower than the maximum relative magnetic permeability of said at least a third ferromagnetic material.

25. The method according to claim 24, wherein said magnetic shield further comprises:

at least a fourth layer radially external to said at least a third layer, said at least a fourth layer comprising at least a fourth ferromagnetic material, the maximum relative magnetic permeability of said at least a third ferromagnetic material being lower than the maximum relative magnetic permeability of said at least a fourth ferromagnetic material.

26. A multiple-layer magnetic shield, comprising:

a first radially inner layer comprising at least a first ferromagnetic material, and at least a second layer radially external to said first layer, and comprising at least a second ferromagnetic material, wherein the maximum relative magnetic permeability of said at least first ferromagnetic material is lower than the maximum relative magnetic permeability of said at least second ferromagnetic material.

27. The multiple-layer magnetic shield according to claim 26, wherein the maximum relative magnetic permeability of the ferromagnetic materials forming each layer of said shield increases from said first layer toward said at least second layer.

28. The multiple-layer magnetic shield according to claim 26, wherein each layer of said shield is produced by taping.

29. The multiple-layer magnetic shield according to claim 28, wherein each layer is made from a plurality of windings.

30. The multiple-layer magnetic shield according to claim 26, wherein each layer of said shield has a tubular shape.

31. The multiple-layer magnetic shield according to claim 30, wherein said tubular shape is produced by extrusion.

32. The multiple-layer magnetic shield according to claim 30, wherein said tubular shape is produced by rolling and subsequent bending and welding.

33. The multiple-layer magnetic shield according to claim 26, wherein each layer of said shield is made from a ferromagnetic material chosen from the group comprising: silicon steel, metallic glass alloys, or polymer materials filled with ferromagnetic materials.

34. The multiple-layer magnetic shield according to claim 33, wherein said ferromagnetic materials, with which said polymer materials are filled, are chosen from the group comprising: ferromagnetic nanoparticles, powered ferrite and iron filings.

35. The multiple-layer magnetic shield according to claim 26, further comprising:

at least a third layer radially external to said at least a second layer, said at least a third layer comprising at least a third ferromagnetic material, the maximum relative magnetic permeability of said at least a second ferromagnetic material being lower than the maximum relative magnetic permeability of said at least a third ferromagnetic material.

36. The multiple-layer magnetic shield according to claim 35, further comprising:

at least a fourth layer radially external to said at least a third layer, said at least a fourth layer comprising at least a fourth ferromagnetic material, the maximum relative magnetic permeability of said at least a third ferromagnetic material being lower than the maximum relative magnetic permeability of said at least a fourth ferromagnetic material.

* * * * *